United States Patent [19]

Coyon et al.

[11] Patent Number: 4,594,280

[45] Date of Patent: Jun. 10, 1986

[54] EXPANDED PERFORATED SHEET HAVING INTEGRAL UNEXPANDED SIDES AND METHOD OF MANUFACTURING THE SAME

[75] Inventors: Claude Coyon; Bernard Bernet, both of Montbard, France

[73] Assignee: La Metal Deploye, Clamart, France

[21] Appl. No.: 576,271

[22] Filed: Feb. 2, 1984

[30] Foreign Application Priority Data

Feb. 3, 1983 [FR] France ..... 83 01699

[51] Int. Cl.[4] ..... B21D 31/04; B21D 13/10; B21D 53/04

[52] U.S. Cl. ..... 428/135; 428/131; 428/136; 428/596; 428/613; 210/493.5; 210/498; 338/206; 29/163.5 R; 29/163.5 F; 264/282

[58] Field of Search ..... 428/137, 134, 135, 136, 428/596, 613, 152, 155, 181; 264/41; 29/163.5 R, 163.5 F; 210/499, 510.1, 493.5, 498; 338/206, 208, 212; 165/DIG. 8

[56] References Cited

U.S. PATENT DOCUMENTS

| | | | |
|---|---|---|---|
| 2,570,692 | 10/1951 | Knight | 338/206 |
| 2,891,303 | 6/1959 | Stevenson | 428/596 |
| 3,813,743 | 6/1974 | Harrell et al. | 29/163.5 X |
| 4,068,366 | 1/1978 | Hillesheim | 29/163.5 X |
| 4,124,925 | 11/1978 | Barnett | 29/163.5 X |
| 4,359,181 | 11/1982 | Chisholm | 29/163.5 X |

*Primary Examiner*—Joseph L. Schofer
*Assistant Examiner*—F. M. Teskin
*Attorney, Agent, or Firm*—Brisebois & Kruger

[57] ABSTRACT

A perforated structure of expanded material, including at least one solid unstretched strip (4) parallel to the direction of expansion and of a length less than the length of the expanded region. The expanded region is formed with a tool that simultaneously cuts or perforates and expands the material.

20 Claims, 8 Drawing Figures

VII
VI
V
V
5
6 h
5
7
8
14
13
14

5
11
9
F3
10
F2

5

5
12
6
α

EXPANDED PERFORATED SHEET HAVING INTEGRAL UNEXPANDED SIDES AND METHOD OF MANUFACTURING THE SAME

This invention relates to perforated and expanded structures, and more particularly to such structures having at least one integral solid or unexpanded band or strip along a side region of the expanded structure, and parallel to the direction of expansion. The structure can be formed from many materials such as metal, paper, cloth or fabric, or synthetic materials such as plastic.

BACKGROUND OF THE INVENTION

Expanded metal structures are known in which a metal sheet or foil is slit or perforated to leave at each of its sides a solid band or strip, and these sides are then stretched to expand the slit or perforated portion. Usually, the solid side bands are rolled to increase their length. These solid bands are thus of the same length as the surface length of the expanded portion of the slit or perforated structure. There results a structure expanded in certain regions and solid in other regions. Such stretching of the sides decreases their thickness so the sides are thinner than the expanded material regions.

Such structures have, in certain applications, for example, in the manufacture of fluid or liquid filters, the disadvantage of requiring exterior dimensions which are relatively large for a given expanded metal suface area, and thus the area of filtering, because of the stretching or rolling of the side bands.

In addition, manufacture is relatively complex, because two unwinding operations are required and the second operation requires rolling the lateral bands to expand the perforated regions of material.

SUMMARY OF THE INVENTION

The present invention overcomes the disadvantages and has for an object a perforated and expanded material structure comprising at least one solid side strip or band parallel to the direction of expansion, characterized by the fact that the band is integral with the expanded portion and has, in the direction of expansion, a length less than the surface length of the expanded portion.

This structure can comprise, for example, a solid integral band along each of the sides of the expanded portion, and parallel to the direction of expansion.

This construction provides folds or undulations in the expanded portion of the structure due to the fact that the expanded portion has a length greater than that of the solid side bands. This does not, however, present a disadvantage in most applications. The undulations of the structure according to the invention permit, on the contrary, use in diverse fields such as decoration. The folds or undulations can be formed into a regular array of pleats or corrugations to stiffen the structure.

The invention has also as an object, a filter characterized by the fact that it comprises at least one structure such as that described above.

The filter can be of any known type in which an expanded metal structure is used, for example, but with the characteristics folding or pleating in the expanded portion of the structure according to the invention, which permits attaining a filter surface area which is much greater for a shorter developed length.

The structure according to the invention can also be used in the manufacture of heat exchangers or electrical heaters or resistors because of its large heat exchange surface relative to its exterior dimensions.

Another object of the invention is a process of making a slit and expanded material structure in which a plate or sheet of the material is simultaneously slit or perforated and stretched, characterized by the fact that at least one solid band or strip, parallel to the direction of stretching of the slit portion of the sheet, is conserved and is not stretched.

One can, for example, leave two solid side bands at opposite sides of a slit and stretched region.

The apparatus to perform this technique to produce the structure can be a conventional machine for forming expanded metal comprising at least one cutter in the form of a succession of teeth and spaces, the cutter being movable essentially perpendicular to the surface of the sheet. The cutter cooperates with an opposed blade and simultaneously cuts or slits and stretches the sheet. If the cutter has a length less than the width of the sheet, one obtains a structure whose central part is expanded, while the two side bands or strips are solid.

Preferably, in accordance with the invention, a tool is used in which the active face of the cutter is convexly rounded toward the sheet, and is inclined with respect to the surface of this sheet.

The active face can, for example, be inclined at about 30° to the surface of the sheet.

Advantageously, the depth and/or the thickness of the teeth decreases progressively towards the extremities of the cutter to limit the risk of rupturing the material at the junction between the solid side region and the stretched region.

Non-limiting embodiments of the invention will now be described with reference to the accompanying drawings.

DETAILED DESCRIPTION

Figure 1:
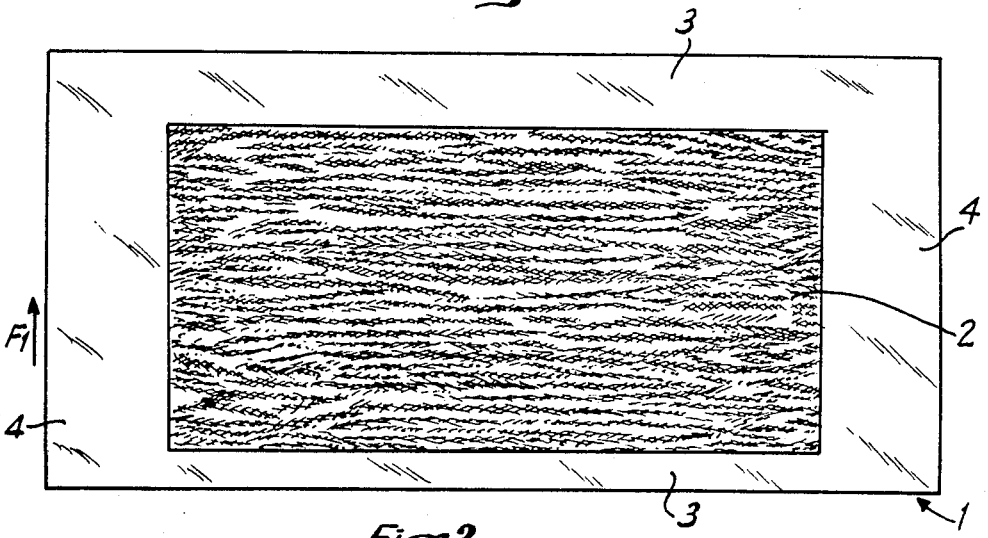
FIG. 1 is a top plan view of a perforated structure according to the invention.

FIG. 1 shows a perforated structure formed from a metal sheet 1 whose central portion or region 2 is expanded. The expansion of portion 2 is effected in the direction of the arrow $F_1$.

The sheet 1 has solid end regions in the form of bands or strips 3 perpendicular to the direction $F_1$ of expansion.

The sheet 1 also has two solid side bands or strips 4 parallel to the direcion of expansion as indicated by the arrow but which are not expanded or stretched during expansion of the portion 2.

Correspondingly, the bands 4 have a length in the sense of the arrow $F_1$ which is less than the developed length of the region 2, in this same direction. In essence, the surface length of region 2 is considerably greater than the length of side bands 4, in a direction parallel to the side bands.

The result is waves or folds in the region 2.

A structure such as that shown at FIG. 1 can be advantageously used as a fluid or liquid filter because of the fact that it has relatively small exterior dimensions in the solid regions 3 and 4, but a larger filter surface because of the waves or folds, in the region 2. In addition, the solid peripheral region composed of the flat coplanar solid bands 3 and 4 facilitates sealing the periphery of the filter assembly.

Figure 2:
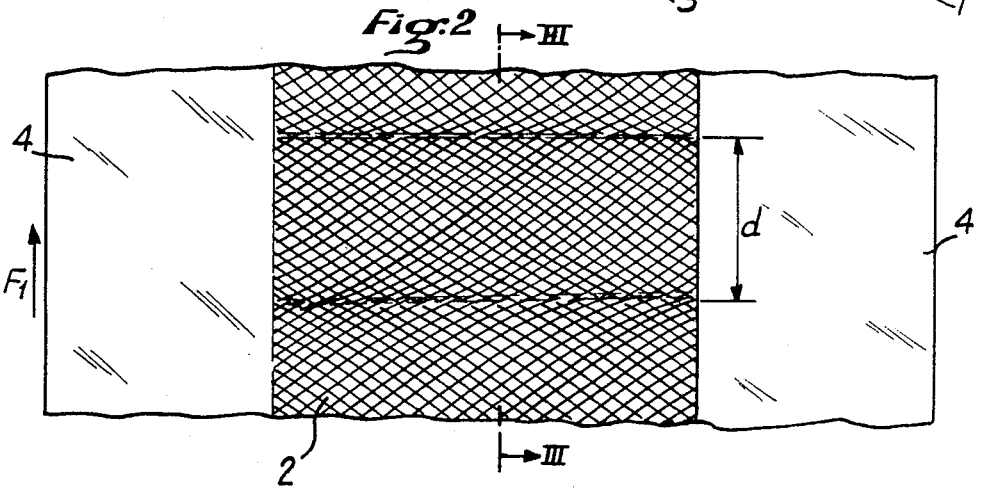
FIG. 2 is a partial top plan view of another structure according to the invention.

FIG. 2 shows another perforated structure according to the invention which also comprises solid lateral bands parallel to the direction $F_1$ of expansion of the expanded region 2, with the integral solid sides 4 again of a length less than the length of the expanded region 2.

The mesh of the region 2 in FIG. 2 is of a length very much greater than that of the structure of FIG. 1 which causes the amplitude d of the waves or folds to be much greater. These folds can be allowed to occur naturally during expanding (as will soon be described) or the expanded region can be periodically creased.

The perforated structure of FIG. 2 as well as that shown in FIG. 1 can be provided with four solid side bands, or with only three bands or with only two side bands. A structure comprising at one perforated and expanded portion, and at least one integral solid edge strip parallel to the direction of expansion can be used as an electrical resistor.

A structure comprising only two solid bands 4 (parallel to the direction of expansion) one at each side of the expanded portion, can advantageously be used as an electrical resistance element. Such an element has remarkable rigidity because of the waves or corrugations and/or creases in the expanded portion 2.

Figures 4, 5, 6, 7, 8:
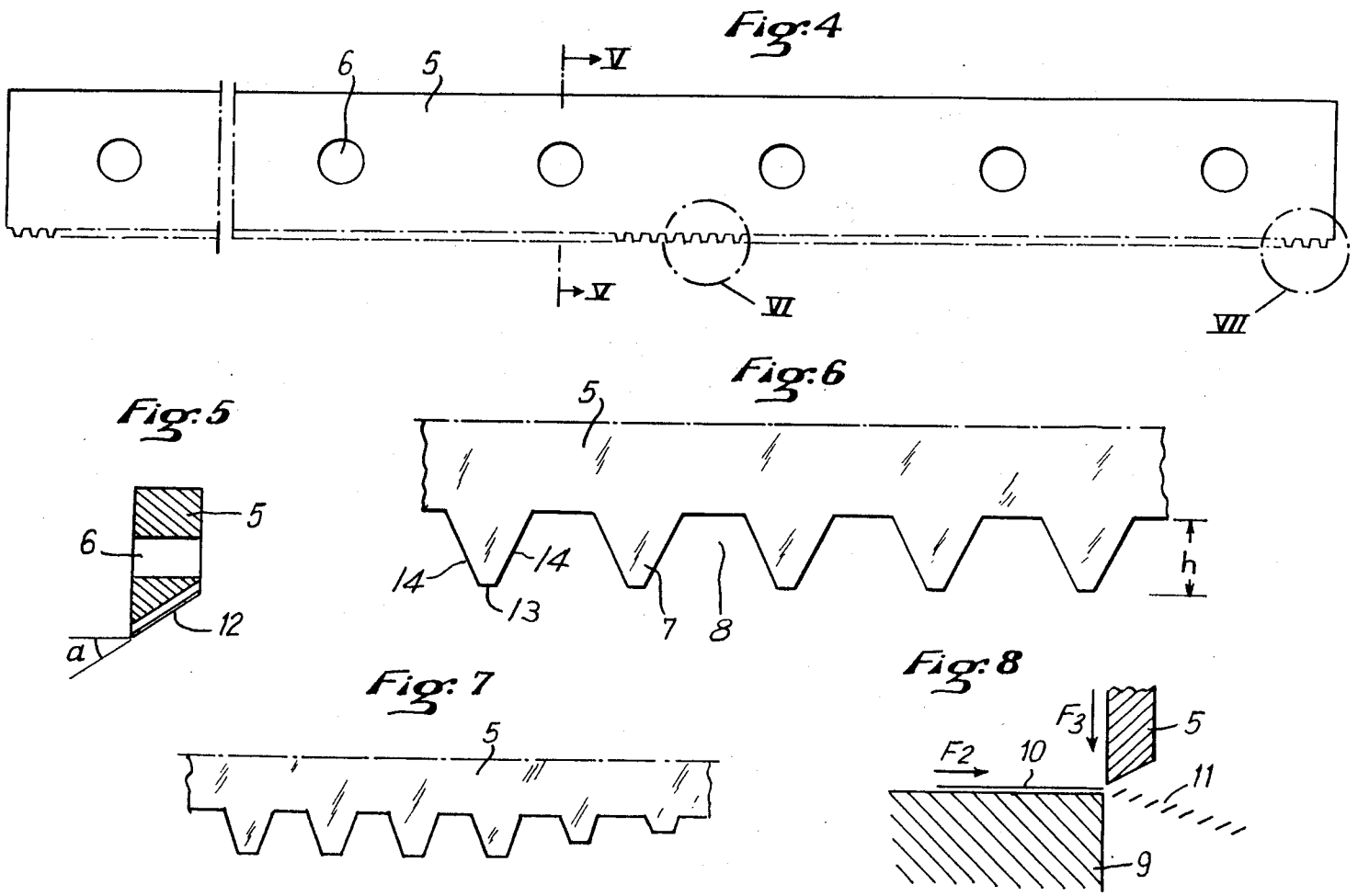
FIG. 4 is a front view in elevation of a tool according to the invention which is used in the fabrication of structures such as those shown at FIGS. 1 and 2.
FIG. 5 is a view in section taken along line V—V of FIG. 4.
FIG. 7 is an enlarged view of the detail VII of FIG. 4.
FIG. 8 is a schematic view in side section showing the operation of a machine with the tool of FIGS. 4 to 6.

FIG. 4 shows a tool for forming the structures of FIGS. 1 and 2. This tool is in the form of a blade or cutter 5 having openings 6 for mounting on a machine. The blade 5 comprises a succession of teeth 7 and spaces 8 between the teeth.

The tool is positioned as shown at FIG. 8 with respect to a counterblade 9, perpendicular to the direction of advance of a metal sheet 10 which is advanced step by step in the direction of the arrow $F_2$. After each advance step, the tool descends perpendicular to the sheet 10, in the direction of the arrow $F_3$ so that the teeth slit and simultaneously expand the metal to form the meshes 11.

Between each descent or working stroke of the blade, the blade is displaced laterally, alternately in opposite directions. The extent of lateral displacement between strokes is preferably equal to one-half the pitch or spacing between the teeth 7.

In accordance with the invention, the lower surface 12 of the tool which is directed toward the sheet 10 and which has the teeth 7 and the spaces 8, forms with the surface of the sheet an angle $\alpha$ which can be equal to about 30°. This lower surface 12 faces away from the direction of feed $F_2$ of the sheet.

The applicant has determined that such an angle of inclination of face 12 permits avoiding rupture of the material adjacent to the junction between the expanded region 2 and the side bands 4.

In addition, as shown at FIG. 7, the depth of the teeth decreases progressively toward the ends of the cutter blade 5.

As shown at FIG. 6, each tooth has a flat bottom edge 13 and sloping sides 14 which converge toward the bottom edge 13.

During operation, as the cutter or tool 5 reciprocates, the extent of downward movement of the tool after edge 13 of the teeth engage the sheet, will never exceed the height h of a tooth. By changing the extent of penetration of each tooth 7 into the sheet, the extent of expansion can be controlled or adjusted. This enables setting up the apparatus to obtain a desired degree of expansion. Thus, the extent of expansion can be controlled to produce different forms of expanded sheet with the same apparatus.

Figure 3:
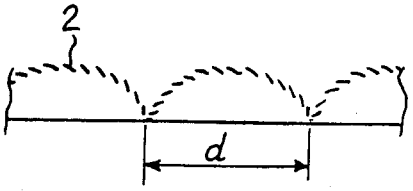
FIG. 3 is a view in section taken along III—III of FIG. 2.

To obtain the structure shown at FIGS. 2 and 3 in which the expanded portion 2 has regularly spaced folds or waves of a dimension d, a creasing station can be provided downstream of the perforating and expanding station shown at FIG. 8, to periodically crease the expanded material and thus provide the creases 2' at regular intervals. Such creasing can be accomplished using a dull blade beneath the expanded portion of the sheet and which is moved upwardly toward a back-up surface above the sheet. Such a creasing blade can be operated in timed relation to the cutting tool 5, and can, for example, make one stroke for each predetermined number of strokes of the cutting blade. For example, the creasing blade can make one stroke for each ten strokes of the cutting tool 5.

To form a series of structures like the structure shown at FIG. 1, cutter 5 can simply be disabled for a predetermined number of feed strokes of sheet 10 in the direction of arrow $F_2$, as shown at FIG. 8. Then, tool 5 can again be enabled to form another expanded region.

Any suitable mechanism can be used for reciprocating tool 5, and any suitable mechanism can be used for advancing sheet 10. Such apparatus is well known in the expanded metal forming art.

It is to be appreciated that the teeth can have a configuration and spacing different from that shown, to form an expanded portion of a desired configuration.

Where a structure such as that shown at FIG. 2 is formed, having solid unstretched sides 4, the effective length of tool 5 will of course be essentially equal to the width of the expanded portion 2 between the sides.

While several embodiments according to the invention have been shown and described, it is to be appreciated that changes and modifications can be made without departing from the scope or spirit of this invention.

What is claimed is:

1. A perforated and expanded sheet material structure comprising, at least one perforated and expanded portion, and at least one integral solid border strip parallel to the direction of the expanded portion, said border strip having a length parallel to the direction of expansion, which is less than the length of the surface of the expanded portion, as measured in a direction parallel to the direction of expansion of the sheet.

2. A structure according to claim 1 comprising an integral solid border strip along each side of the expanded portion, each border strip having a length less than the length of the surface of the expanded portion, in a direction parallel to the direction of expansion.

3. A fluid filter comprising at least one structure according to claim 1.

4. A fluid filter comprising at least one structure according to claim 2.

5. A heat exchanger comprising at least one structure according to claim 1.

6. A heat exchanger comprising at least one structure according to claim 2.

7. An electrical resistor comprising at least one structure according to claim 1.

8. An electrical resistor comprising at least one structure according to claim 2.

9. A method of manufacturing an expanded material structure comprising, simultaneously perforating and expanding a sheet in a predetermined direction to form an expanded region, while maintaining an integral solid unstretched border strip along an edge of the expanded region, parallel to the direction of expansion of the sheet, so that the border strip has a length parallel to the direction of expansion which is less than the length of the expanded portion.

10. A method according to claim 9 wherein said method further comprises maintaining an integral solid unstretched edge strip on opposite sides of the expanded region, parallel to the direction of expansion of the sheet.

11. A method according to claim 9 wherein said step of simultaneously perforating and expanding comprises perforating the sheet with a series of spaced apart cutting teeth by moving the teeth in a direction generally perpendicular to the surface of the sheet and into the sheet, while maintaining surfaces of the teeth inclined to the surface of the sheet, to simultaneously expand the perforated portions of the sheet.

12. A method according to claim 11 wherein said surfaces of said teeth are incined at an angle of approximately 30° to the surface of the sheet.

13. A method according to claim 11 further comprising expanding the sheet along the solid unstretched border strip less than at a location remote from the border strip by moving the teeth into the sheet to a lesser depth along the border strip than at a location remote from the border strip.

14. A method according to claim 11 comprising alternately moving the teeth into and withdrawing the teeth out of the sheet, and advancing the sheet while the teeth are withdrawn out of the sheet.

15. A structure according to claim 1 wherein said border strip comprises a side edge strip of the sheet.

16. A structure according to claim 2 wherein said border strip comprises a side edge strip of the sheet.

17. A structure according to claim 7 wherein said border strip comprises a side edge strip of the sheet.

18. A structure according to claim 8 wherein said border strip comprises a side edge strip of the sheet.

19. A method according to claim 9 wherein said border strip comprises a side edge strip of the sheet.

20. A method according to claim 9 wherein said border strip comprises a side edge strip of the sheet.

* * * * *